US005765754A

United States Patent [19]

Emilsson

[11] Patent Number: 5,765,754

[45] Date of Patent: Jun. 16, 1998

[54] MOBILE UNIT FOR APPLYING FLUIDS ON LARGE SURFACES, IN PARTICULAR FLOOR SURFACES

[76] Inventor: Hakan Emilsson, Skeppar Sjostroms Vag 3, Varmdo, S-139 34, Sweden

[21] Appl. No.: 682,738

[22] PCT Filed: Jan. 13, 1995

[86] PCT No.: PCT/SE95/00023

§ 371 Date: Jul. 24, 1996

§ 102(e) Date: Jul. 24, 1996

[87] PCT Pub. No.: WO95/20438

PCT Pub. Date: Aug. 3, 1995

[30] Foreign Application Priority Data

Jan. 28, 1994 [SE] Sweden ..... 9400262

[51] Int. Cl.[6] ..... B05B 1/28; B05B 3/18

[52] U.S. Cl. ..... 239/120; 239/754; 239/288

[58] Field of Search ..... 239/146, 172, 239/722, 754, 288, 288.3, 288.5, 105, 120; 15/320, 346

[56] References Cited

U.S. PATENT DOCUMENTS

| | | | |
|---|---|---|---|
| 4,264,999 | 5/1981 | Monson | 15/320 X |
| 4,282,626 | 8/1981 | Schneider | 15/320 |
| 5,028,004 | 7/1991 | Hammelmann | 239/120 |
| 5,077,863 | 1/1992 | Rench | 15/320 X |
| 5,302,210 | 4/1994 | Whyte | 15/320 X |
| 5,460,657 | 10/1995 | Ally | 15/320 X |
| 5,647,092 | 7/1997 | Miwa | 15/346 |

FOREIGN PATENT DOCUMENTS

| | | | |
|---|---|---|---|
| 3316952 | 11/1984 | Germany | 15/346 |
| 2138280 | 10/1984 | United Kingdom | 15/346 |
| 2211227 | 6/1989 | United Kingdom | 15/346 |

*Primary Examiner*—Lesley D. Morris
*Attorney, Agent, or Firm*—Linn I. Grim

[57] ABSTRACT

A mobile unit for applying fluids, such as paint, on large surfaces, in particular floor surfaces, comprises a number of spraying means (14) mounted in a casing (7). The spraying means are surrounded by an encircling shielding (9). The casing (7) has an opening exposed towards a fluid application surface. In the unit there is an air evacuating device (21) having the task of providing a flow of air into the interior of the casing (7) from an air gap established between the application surface and a free edge (16) of the shielding, so as to minimize the emission of particles from the unit to the surroundings in connection with the application of fluid onto the surface.

13 Claims, 2 Drawing Sheets

MOBILE UNIT FOR APPLYING FLUIDS ON LARGE SURFACES, IN PARTICULAR FLOOR SURFACES

TECHNICAL FIELD OF THE INVENTION

In a first broad aspect the present invention relates to a mobile unit for applying fluids on large surfaces. In a closer aspect the invention relates to a unit for painting in particular floor surfaces.

BACKGROUND OF THE INVENTION

In the paintwork technique it occurs that large coating surfaces are re-painted at short intervals. This is for instance the case in studio premises for filming purposes. Film-directors in charge sometimes desire a certain color on the floor of the room and sometimes quite another color; all depending on the character of the current film production. This means that the service staff which are responsible for the indoor picture may have to repaint the floor of the room at short intervals, since repainting has to be carried out not only between the production of different movies, but also between different sequences in one and the same movie. As the floor surfaces of the studio premises can amount to many hundreds of square meters or more, it is realized that the painting work is extremely burdensome when it has to be carried out manually as hitherto customary, either by means of brushes/rollers or alternatively by means of spray nozzles held by hand.

OBJECTS AND FEATURES OF THE INVENTION

In its closer aspect the present invention aims at providing a mobile painting unit by means of which the painting of large surfaces, such as the floor surfaces of a studio premise, can be facilitated and rendered more effective. Accordingly, a primary object of the invention is to provide a unit which is capable of applying paint swiftly and efficiently on large surfaces without giving rise to environmental inconveniences in the surroundings of the unit. Thus, the unit according to the invention shall make it possible to apply paint of e.g. an indoor coating surface without giving rise to troublesome air pollutions in the environment. A further object of the invention is to provide a unit which can be driven along the coating surface in question in a manner which is comfortable and ergonomically appropriate for the operator. In its broader aspect the invention also aims at providing a unit for applying other arbitrary fluids than paint on a selected surface irrespective of whether this is a floor surface or another substrate.

BRIEF DESCRIPTION OF THE ATTACHED DRAWINGS In the drawings:

FIG. 1 is a perspective view of a first unit according to the invention, integrated with a motor-driven vehicle, and FIG. 2 a partly cut schematic perspective view of a second, developed embodiment of a unit according to the invention, likewise integrated with a motor-driven vehicle.

DETAILED DESCRIPTION OF PREFERRED EMBODIMENTS

Figure 1:
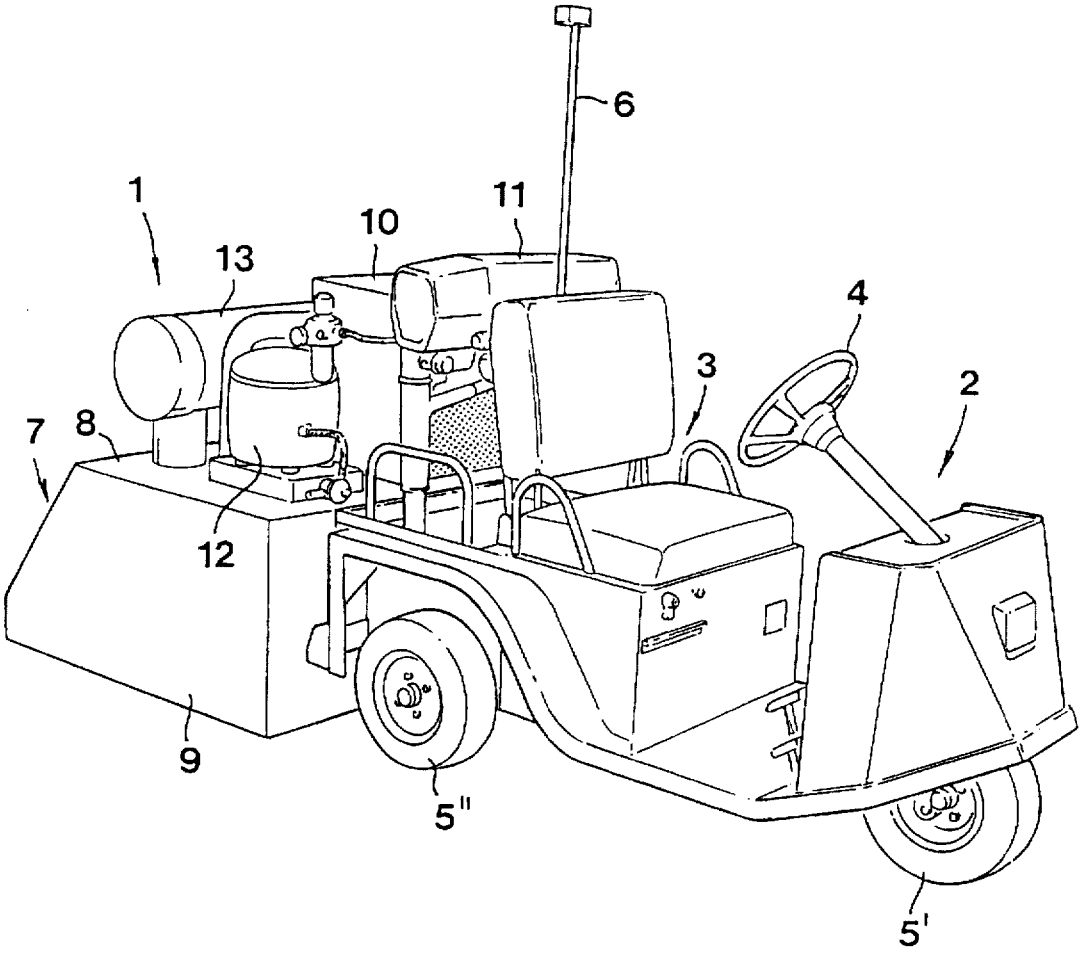

In FIG. 1 a fluid application unit according to the invention is generally designated 1. Is accordance with a preferred embodiment of the invention this unit is built up on a wheeled and motor-driven vehicle generally designated 2. In the example the vehicle is a three-wheeler including a driver's seat 3, a front-mounted steering wheel 4 for controlling the single front wheel 5' of the vehicle (the two rear wheels of the vehicle are designated 5") as well as an electric motor which is enclosed in a box under the driver's seat and by means of which the vehicle can be driven in a conventional manner. The necessary power supply may be provided through a swivelled cable (not shown) which is supported by a post 6 mounted behind the driver's seat. It is, however, also possible to use batteries for the power supply of the motor.

The unit 1 is preferably mounted at the rear end of the vehicle 2. The externally visible components included in the unit 1 of the embodiment according to FIG. 1 consist of a casing generally designated 7, which comprises a substantially horizontal plate 8 forming a frame as well as a shielding or border generally designated 9 which projects downwardly from said frame plate. On top of the frame plate 8 a housing 10 is mounted in the interior of which an air evacuating device in the form of a suction fan is arranged. Visible in FIG. 1 are furthermore a pump 11, a compressor 12 and an air distributor 13. The pump and the compressor are parts of an equipment for feeding paint to a number of paint spraying means or nozzles mounted within the casing 7, said equipment being known per se or of an arbitrary type.

Figure 2:
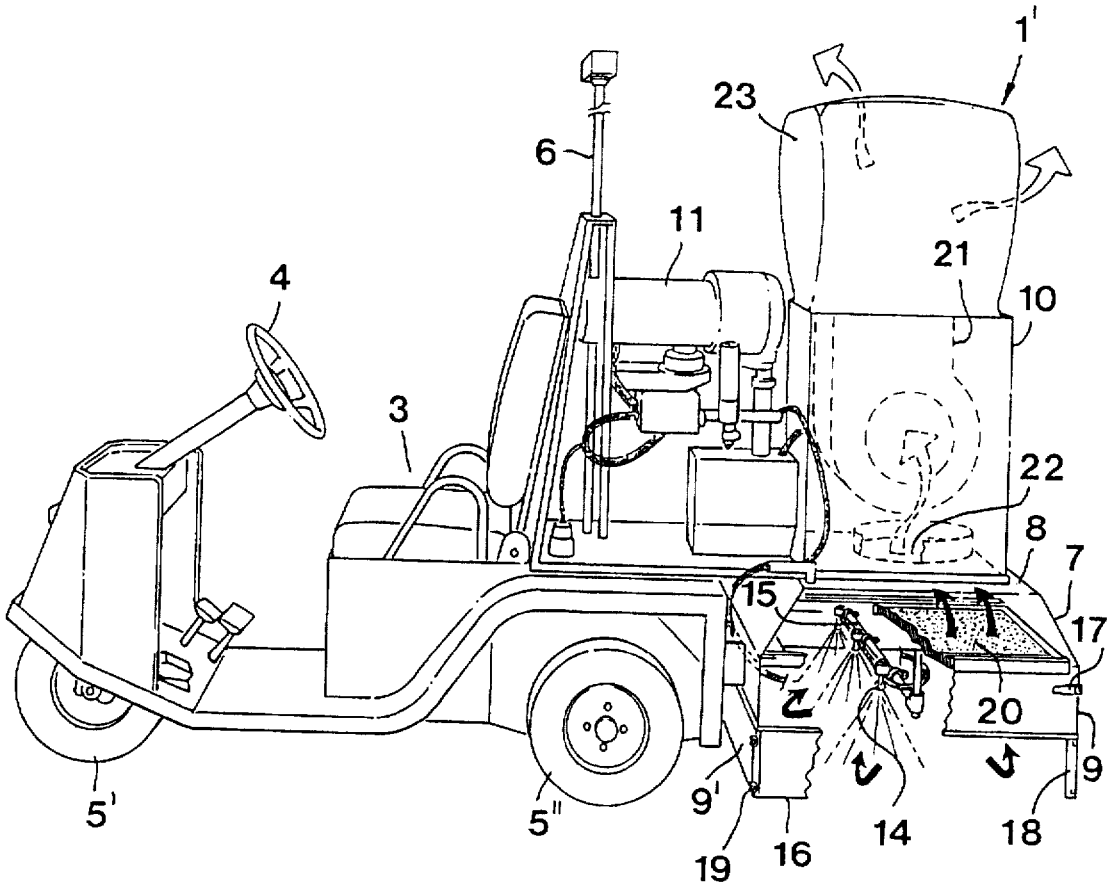

Reference is now made to FIG. 2 which in detail illustrates the interior of the casing 7 and the housing 10, more particularly in an embodiment designated 1' which is further developed in relation to the embodiment of FIG. 1. As seen from FIG. 2 the unit according to the invention includes a suitable number of spraying means 14, in this case three, by means of which paint can be sprayed onto the floor surface present below the unit. The spraying means 14 are fixedly mounted within the casing 7, more particularly on a support 15 which may be in the form of a tube and which is in a suitable manner fixedly mounted in relation to the frame 8, which in turn is in a suitable manner firmly connected to the chassis of the vehicle 2. From the frame 8 consisting e.g. of a horizontal metal sheet, the shielding 9 projects downwardly and is terminated by a bottom edge designated 16. This shielding 9 is endless or extends round about the casing and may in practice be made of plates or plate sections of which a rear section may be pivotally connected to the frame and locked relative to the side plates by means of locking means 17. In the embodiment shown in FIG. 2 the shielding 9 is square-shaped (rectangular or alternatively quadrangular) while forming four distinctly developed corners. In this preferred embodiment the shielding is divided into an upper part 9 consisting of metal sheets or metal sheet sections firmly connected to the frame plate 8 and a bottom part 9' which is demountable, i.e. removable, from the upper part. For this purpose downwardly projecting pins 18 are attached to the four corners of the shielding. These pins form attachments for a surrounding band which forms the bottom part 9' of the shielding. In practice this band can be made of fabric or another flexible material which can be stretched around the corner pins 18 and held in place by means of suitable fixing members 19 easy to disengage.

Within the casing 7 jointly formed by the frame plate 8 and the shielding 9 one or more air cleaning filters 20 are arranged. More particularly these filters 20 are located in the area above the paint spraying means 14. In practice the filters may be in the form of exchangeable cassettes having a filter material of a conventional or arbitrary type, i.e. a fiber mass or a layer of granules.

In the housing mounted on top of the casing 7 a fan 21 schematically shown, is included. The fan is placed in the vicinity of an aperture 22 recessed in the frame plate 8, said aperture allowing communication between the fan and the interior of the casing 7. On top of the housing 10 there is furthermore a second filter 23 which in this case is in the form of a bag detachably connected to the housing, the walls of the bag being permeable to air. Thus, the filter bag 23 is preferably made of one or more fibrous materials which can, on one hand, let through air and, on the other hand, trap even utterly small solid or liquid particles accompanying the air being evacuated from the interior of the casing 7 by means of the fan. The lower ends of the corner pins 18 and accordingly the bottom edge 16 of the shielding are, according to the invention, located at a certain level above the wheelbase of the vehicle, meaning that an air gap is formed between the bottom edge 16 of the restricting shielding and the underlying floor when the unit is moved along the floor. In practice this air gap may have a height within the range of 5 to 50, preferably 10 to 20 millimeters.

The unit described operates in the following manner. By means of the compressor and the pump paint is fed from a store tank to the various nozzles or spraying means 14 which spray paint on the underlying floor when the unit, by means of the vehicle, is moved along the same. The fan 21 maintains at the same time an upwardly directed air stream through the unit. More particularly air is sucked into the interior of the casing 7 through the air gap between the bottom edge 16 of the shielding and the floor, and is brought to pass the filter unit 20 above the spraying means 14. In this filter unit 20 at least a rough purification of the air is carried out. The purified air leaving the filter unit 20 is thereafter finally cleaned in the fine filter 23 which separates even utterly fine particles perchance accompanying the air after the passage of the filter unit 20. By the fact that an air stream directed into the interior of the casing 7 is always maintained by means of the fan 21 as soon as the spraying means 14 are put into operation, any risk for the emission of paint or liquid in the surroundings of the unit is avoided when the unit is moved along the coating surface.

Conceivable modifications of the invention

Of course the invention is not limited merely to the embodiments described above and shown in the drawings. Thus it is conceivable to make the unit mobile in other ways than by mounting the same on a wheeled vehicle of the type exemplified. Instead of fixedly mounting the unit on the vehicle it is also possible to mount the same adjustably movable to various positions relative to the vehicle, e.g. by connecting the unit to the vehicle via a turning device which allows turning of the unit relative to the vehicle. In the latter case the unit may accordingly also be used for painting of other surfaces than an underlying floor, e.g. vertical wall surfaces. It should also be emphasized that the unit according to the invention may be utilized for the application of other arbitrary fluids than paint irrespective of whether the fluids are liquids or powders.

I claim:

1. A mobile unit for spraying paint onto a large surface comprising:

at least one paint spraying means mounted within a casing for the spraying of said paint onto said surface and surrounded by an encircling shielding included therein, said casing having an opening exposed towards said surface and at least one air evacuating device providing airflow into the interior of the casing from an air gap established between said surface and a free edge of said shielding whereby the emission of particles from the unit to the surroundings is minimized in connection with the application of fluid on said surface.

2. The mobile unit as set forth in claim 1, wherein said air evacuating device comprises a suction fan which is mounted in said casing for drawing air through said casing via said opening for releasing the same through an outlet from said casing.

3. The mobile unit as set forth in claim 1, wherein said casing includes at least one filter arranged within said casing between said spraying means and said air evacuating device for purifying the air before it passes said air evacuating device.

4. The mobile unit as set forth in claim 2, wherein said casing includes at least one filter arranged within the casing between said spraying means and said air evacuating device for purifying the air before it passes said air evacuating device.

5. The mobile unit as set forth in claim 4, wherein said mobile unit includes at least one second filter mounted in spaced relation to said air evacuating device.

6. The mobile unit as set forth in claim 1, wherein said shielding has a free edge and includes of at least one fixed plate and at least one band removably mounted thereto, an edge portion of said band forming said free edge of said shielding directed towards said surface.

7. The mobile unit as set forth in claim 2, wherein said shielding has a free edge and includes at least one fixed plate and at least one band removably mounted thereto, an edge portion of said band forming said free edge of said shielding directed towards said surface.

8. The mobile unit as set forth in claim 3, wherein said shielding has a free edge and includes at least one fixed plate and at least one band removably mounted thereto, an edge portion of said band forming said free edge of said shielding directed towards said surface.

9. The mobile unit as set forth in claim 4, wherein said shielding has a free edge and includes at least one fixed plate and at least one band removably mounted thereto, an edge portion of said band forming said free edge of said shielding directed towards said surface.

10. The mobile unit as set forth in claim 5, wherein said shielding has a free edge and includes at least one fixed plate and at least one band removably mounted thereto, an edge portion of said band forming said free edge of said shielding directed towards said surface.

11. The mobile unit as set forth in claim 6, wherein said band is removably mounted on pins, said pins projecting downwardly from said at least one fixed plate.

12. The mobile unit as set forth in claim 1, in combination with a motor-driven vehicle.

13. The mobile unit as set forth in claim 12, wherein said casing of said mobile unit is rigidly connected to said vehicle.

* * * * *